US007306477B1

(12) United States Patent
Huang et al.

(10) Patent No.: US 7,306,477 B1
(45) Date of Patent: Dec. 11, 2007

(54) CONDUCTING WIRE CONNECTION DEVICE

(75) Inventors: Yu-Cheng Huang, Hsinchu (TW); Tzn-Chih Lin, Hsinchu (TW)

(73) Assignee: Altek Corporation, Hsinchu (TW)

( * ) Notice: Subject to any disclaimer, the term of this patent is extended or adjusted under 35 U.S.C. 154(b) by 0 days.

(21) Appl. No.: 11/498,243

(22) Filed: Aug. 3, 2006

(51) Int. Cl.
*H01R 4/24* (2006.01)

(52) U.S. Cl. ..... 439/441; 439/353

(58) Field of Classification Search ..... 439/353, 439/417, 436–438, 441
See application file for complete search history.

(56) References Cited

U.S. PATENT DOCUMENTS 2,713,668 A * 7/1955 Gibilisco ..... 439/438
4,084,876 A * 4/1978 Dinger ..... 439/439
4,978,315 A * 12/1990 Edgley et al. ..... 439/441
5,174,784 A * 12/1992 Penning ..... 439/439
6,012,944 A * 1/2000 Hatakeyama ..... 439/441
6,080,008 A * 6/2000 Frantz ..... 439/441
6,570,306 B2 * 5/2003 Henrici et al. ..... 313/318.01
6,981,890 B2 * 1/2006 Cutler et al. ..... 439/441

* cited by examiner

*Primary Examiner*—Michael C. Zarroli
(74) *Attorney, Agent, or Firm*—Rosenberg, Klein & Lee

(57) ABSTRACT

A conducting wire connection device comprises a hollow shell-shaped connection base body and a resilient locking portion. The connection base body has an opening for insertion of a conducting wire. One end of the resilient locking portion is disposed on the connection base body, and the other end thereof extends inwards to form an acute angled end. The acute angled end is near the inner surface of the connection base body to form a clamping position. A conducting wire can be abutted against by the acute angled end of the resilient locking portion when passing through the clamping position so that the conducting wire can be fixed in the connection base body. Therefore, plug-in or pull-out of a naked conducting wire can be directly accomplished with the provided conducting wire connection device.

9 Claims, 4 Drawing Sheets

CONDUCTING WIRE CONNECTION DEVICE

BACKGROUND OF THE INVENTION

1. Field of the Invention

The present invention relates to a connection device and, more particularly, to a conducting wire connection device.

2. Description of Related Art

Conventionally, there are two correct and reliable methods of installing conducting wires in an electronic device. One is soldering naked conducting wires directly on a printed circuit board (PCB) to achieve electric connection of the conducting wires and the PCB. The other is using a conducting wire connector that exploits the connection of a male and a female connectors to install the conducting wires in the electronic device. For instance, the female connector of the conducting wire connector is disposed on a PCB, and the male connector is provided at one end of the conducting wires. Through the connection of the male and female connectors, electric connection of the conducting wires and the PCB can be accomplished. The latter method has the advantages of convenient installation and exact connection.

The above two methods of connecting a conducting wire, however, have drawbacks for electronic devices with small number of pins such as cameras, mobile phones and camcorders. Install conducting wires by means of soldering has the drawback of difficult desoldering. Although using the conducting wire connector to install conducting wires can conquer the trouble of difficult desoldering, the manufacturing cost will rise for electronic devices with small number of pins. In consideration of the above problems, the present invention aims to propose a conducting wire connection device.

SUMMARY OF THE INVENTION

One object of the present invention is to provide a conducting wire connection device, in which naked conducting wires can be directly plug in or pulled out to improve the disadvantage of difficult desoldering in the prior art.

Another object of the present invention is to provide a conducting wire connection device, which has the advantage of low cost.

To achieve the above objects, the present invention provides a conducting wire connection device, which comprises a hollow shell-shaped connection base body and a resilient locking portion. The connection base body has an opening for insertion of a conducting wire. One end of the resilient locking portion is disposed on the connection base body, and the other end thereof extends inwards to form an acute angled end. The acute angled end is near the inner surface of the connection base body to form a clamping position. A conducting wire can be abutted against by the acute angled end of the resilient locking portion when passing through the clamping position so that the conducting wire can be fixed in the connection base body. The connection base body is made of metallic material, and is a rectangular hollow shell body. The conducting wire is a single core wire. The resilient locking portion is a resilient piece.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

The present invention provides a connection device for installing conducting wires. Different from the prior art where conducting wires are installed by means of soldering or a conducting wire connector having male and female connectors. Instead, naked conducting wires are directly plug in the connection device to be fixed in the connection device.

Figure 1:
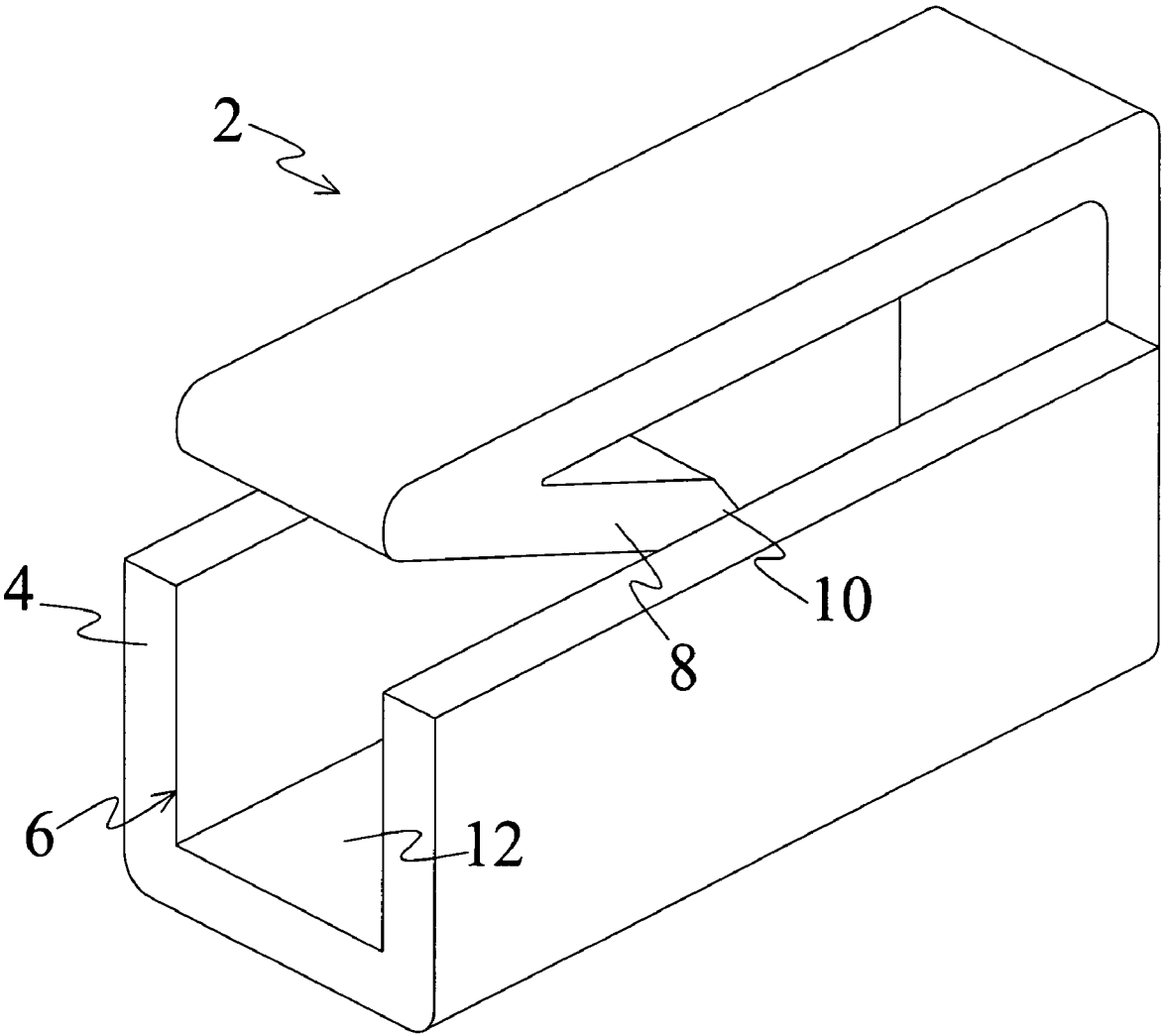
FIG. 1 is a perspective view of the present invention.
Figure 2:
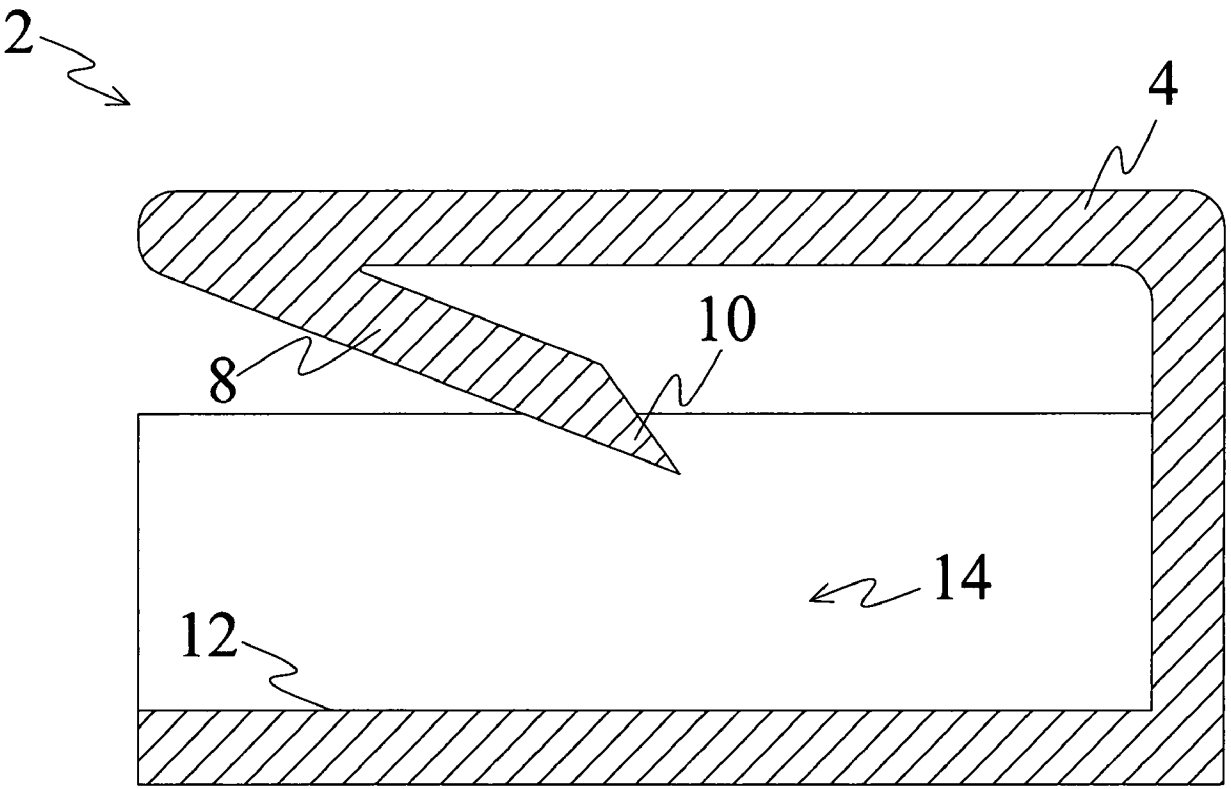
FIG. 2 is a cross-sectional view of the present invention.

As shown in FIGS. 1 and 2, a conducting wire connection device 2 comprises a rectangular hollow shell-shaped connection base body 4 and a resilient piece 8 used as a resilient locking portion. The connection base body 4 is made of metallic material, and has an opening 6 for insertion of a conducting wire. The resilient piece 8 and the connection base body 4 are integrally formed together. One end of the resilient piece 8 is located on the connection base body 4, and the other end thereof extends inwards to form an acute angled end 10. The acute angled end 10 is near an inner surface 12 of the connection base body 4 to form a clamping position 14.

Figure 3:
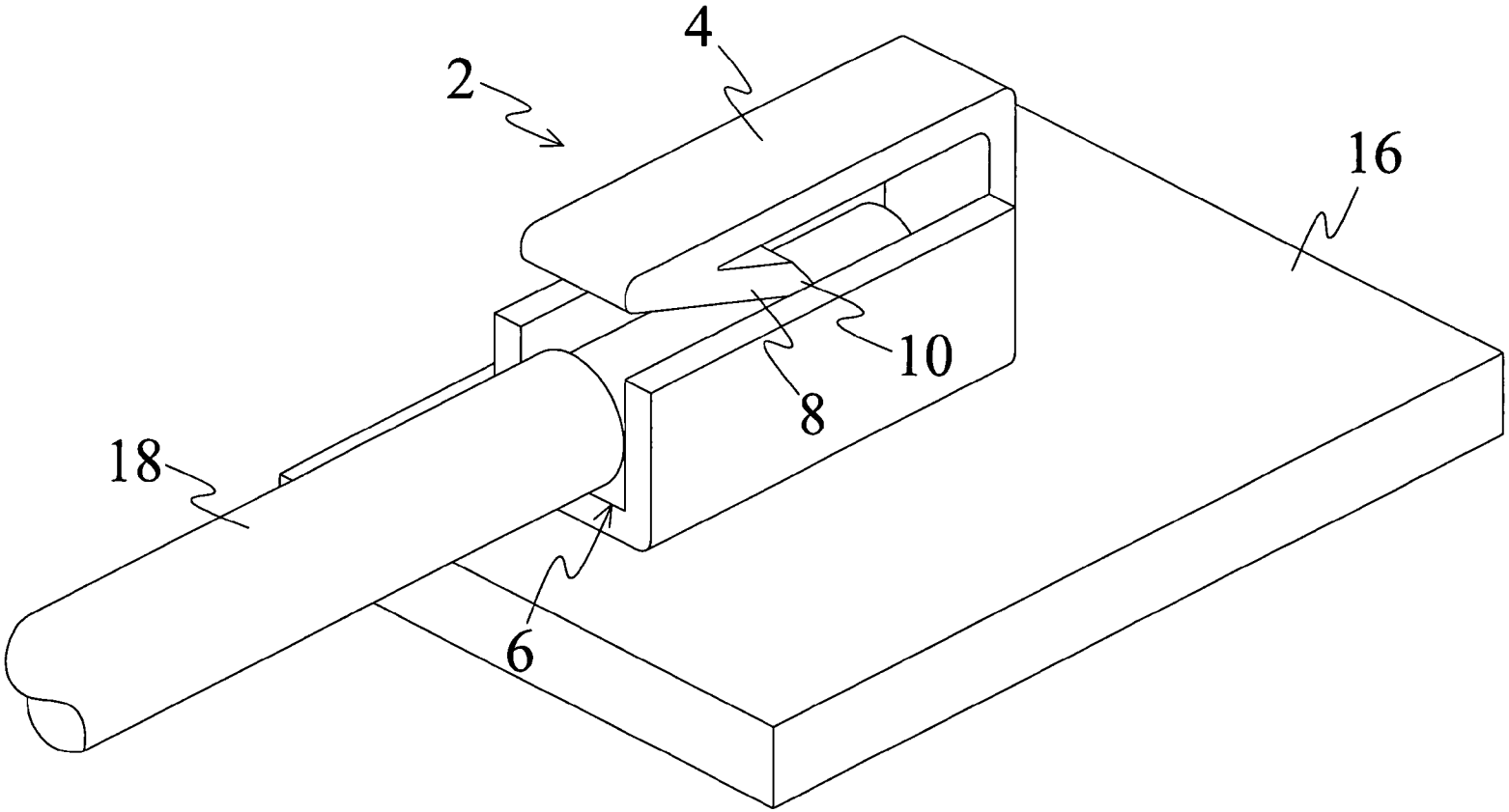
FIG. 3 is a perspective view of the present invention that is installed on a PCB and has a conducting wire plug therein.
Figure 4:
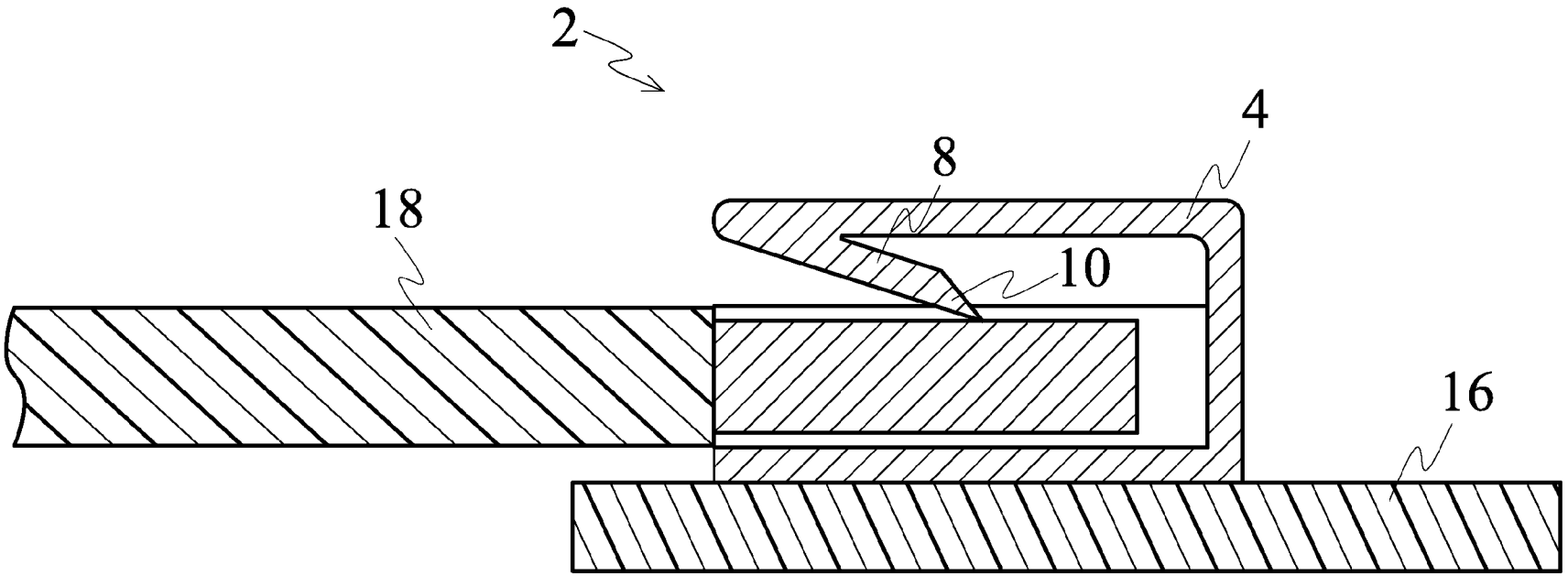
FIG. 4 is a cross-sectional view of the present invention that is installed on a PCB and has a conducting wire plug therein.

As shown in FIGS. 3 and 4, the connection base body 4 of the conducting wire connection device 2 is disposed on a printed circuit board (PCB) 16 by means of mechanical wire bonding or soldering. A conducting wire (e.g., a single core wire 18) to be electrically connected with the PCB 16 passes through the opening 6 of the connection base body 4 and is then plug in the connection base body 4. Through the help of the design of the rectangular hollow shell-shaped connection base body 4, after the single core wire 18 passes through the clamping position 14, the single core wire 18 is abutted against by the acute angled end 10 of the resilient piece 8 so that the single core wire 18 can only move inwards but cannot move left and right or outwards. Therefore, the single core wire 18 can be fixed in the connection base body 4. In the present invention, the conducting wire is directly plug in the connection device to be fixed in the connection device. When applied to electronic devices with small number of pins such as cameras, mobile phones and camcorders, the present invention can provide a low-cost way of connecting conducting wires.

Moreover, if the single core wire 18 is to be moved away from the connection base body 4, it is only necessary to press the resilient piece 8 to move the acute angled end 10 of the resilient piece 8 away from the single core wire 18. That is, the position where single core wire 18 is abutted against by the acute angled end 10 is loosened to let the single core wire 18 move outwards and come off the connection base body 4. The shape of the connection base body 4 is not limited to the rectangular hollow shell shape, and it is not necessary that the resilient piece 8 and the connection base body 4 are integrally formed together. The only conditions are that one end of the resilient piece 8 is disposed on the connection base body 4 and the other end thereof extends inwards to form the acute angled end 10, and the acute angled end 10 is near the inner surface 12 of the connection base body 4 to form the clamping position 14.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

We claim:

1. A conducting wire connection device comprising:

a connection base body being a hollow metallic shell, said connection base body having an opening for insertion of a conducting wire; and a resilient locking portion with one end disposed on said connection base body and another end extending inward to form an acute angled end, said acute angled end being near an inner surface of the connection base body to form a clamping position, a conducting wire being abutted against said inner surface of said connection base body by said acute angled end of said resilient locking portion to affix the conducting wire in said connection base body responsive to the conducting wire being inserted into said opening passed said clamping position, said connection base body being devoid of any physical contact with any insulating housing.

2. The conducting wire connection device as claimed in claim 1, wherein said connection base body is a rectangular hollow shell body.

3. The conducting wire connection device as claimed in claim 1, wherein said conducting wire is a single core wire.

4. The conducting wire connection device as claimed in claim 1, wherein said connection base body is disposed on a PCB and electrically connected with said PCB so that said conducting wire achieves an electrical connection with said PCB when fixed in said connection base body.

5. The conducting wire connection device as claimed in claim 4, wherein said connection base body is electrically connected to said PCB by means of soldering.

6. The conducting wire connection device as claimed in claim 1, wherein said connection base body and said resilient locking portion are integrally formed together.

7. The conducting wire connection device as claimed in claim 1, wherein said resilient locking portion is a resilient piece.

8. The conducting wire connection device as claimed in claim 1, wherein said acute angled end of said resilient locking portion is displaceable from said conducting wire to release said conducting wire from said connection base body.

9. A conducting wire connection device comprising:

a connection base body being a hollow shell said connection base body having an opening for insertion of a conducting wire; and a resilient locking portion with one end extending from said connection base body and an opposing end extending inwards to form an acute angled end, said acute angled end being near an inner surface of said connection base body to form a clamping position, a conducting wire being abutted against said inner surface of said connection base body by said acute angled end of said resilient locking portion to affix the conducting wire in said connection base body responsive to the conducting wire being inserted into said opening passed said clamping position, said connection base body being electrically connected with a PCB by means of mechanical wire bonding, so that said conducting wire achieves an electrical connection with said PCB when fixed in said connection base body.

* * * * *